United States Patent [19]

Roberts, Jr.

[11] 4,451,164

[45] May 29, 1984

[54] DISPENSING CONTAINER

[76] Inventor: James E. Roberts, Jr., 1825 Washington Blvd., NW., Canton, Ohio 44709

[21] Appl. No.: 410,303

[22] Filed: Aug. 23, 1982

Related U.S. Application Data

[63] Continuation of Ser. No. 168,508, Jul. 14, 1980, abandoned.

[51] Int. Cl.[3] ..... B43M 11/06; A46B 11/04

[52] U.S. Cl. ..... 400/196; 400/274

[58] Field of Search ..... 401/274, 196, 202, 152, 401/156, 183, 185, 186, 162, 198, 289, 184; 15/114, 118

[56] References Cited

U.S. PATENT DOCUMENTS

| | | | |
|---|---|---|---|
| 2,186,832 | 1/1940 | Hertzberg | 15/114 |
| 2,919,455 | 1/1960 | Turner | 401/196 |
| 2,941,225 | 6/1960 | Paul | 15/118 |
| 2,958,885 | 11/1960 | Donney | 401/196 |
| 2,969,626 | 1/1961 | Rudes | 401/196 |
| 3,007,192 | 11/1961 | Quoss | 401/196 |
| 3,021,649 | 2/1962 | Robbins | 151/118 |
| 3,038,187 | 6/1962 | Nathanson | 15/118 |
| 3,040,353 | 6/1962 | Gray | 15/118 |
| 3,086,241 | 4/1963 | Bohn | 401/9 |
| 3,491,397 | 1/1970 | Hesener | 15/118 |
| 3,519,364 | 7/1970 | Truhan | 401/196 |
| 3,629,896 | 12/1971 | Sirnec | 15/118 |
| 3,638,270 | 2/1972 | Schlegel, Jr. et al. | 15/114 |
| 4,008,968 | 2/1977 | Hobbs | 401/196 |
| 4,225,254 | 9/1980 | Holberg | 401/196 |

FOREIGN PATENT DOCUMENTS

| | | | |
|---|---|---|---|
| 473262 | 7/1952 | Italy | 401/202 |
| 80311 | 6/1952 | Norway | 401/202 |

*Primary Examiner*—William Pieprz

*Attorney, Agent, or Firm*—Oldham, Oldham, Hudak, Weber & Sand Co.

[57] ABSTRACT

A dispensing container for liquid wherein the total of all of the internal forces operating on the liquid and tending to cause it to flow from a passageway in the container is overcome when the container is at rest by the total external forces acting upon the container, but wherein the total internal forces exceed the external forces when the liquid within the container is placed in motion to cause the dispensing thereof.

Specifically a dish scrubber including a hollow handle having one closed end, one open end and a removable closure for such open end with one or a pair of horizontally aligned small passageways in the handle wall adjacent the closed end, and a porous sponge body surrounding the closed end of the tube, the container, handle and the passageways being dimensionally related in size, shape, and location so that the total forces of gravity, force due to hydrostatic pressure, force due to atmospheric pressure, forces of adhesion, forces of cohesion, surface tension phenomenon, and characteristics of the contained liquid produce a net resultant force that will contain the liquid within the container when it is at rest, but release the liquid when additional force is applied to the contained liquid by placing the container in motion.

4 Claims, 5 Drawing Figures

DISPENSING CONTAINER

This is a continuation of Ser. No. 168,508, filed July 14, 1980 now abandoned.

BACKGROUND ART

Heretofore there have been various types of dispensing containers provided but they have not efficiently dispensed contained liquids, and hand held dish washers are one example of such a dispenser. Commercially available dish washers used today comprise a hollow plastic handle with a small rectangular piece of porous sponge attached to one side or end of the washer. Said operative end of the washer has a hole therein, normally, and detergent seeps out of the tube into the porous sponge at all times, and by wetting this sponge, a dish washing and cleaning action can be obtained by the washer. The dish washers of current art have no sponge material extending around the end of the hollow handle and cannot clean into corners or the bottoms of tall glasses very well, and the dish washer sponge has a relatively short service life due to the inability of the soft sponge to withstand the continuous cuts and abuse from knife edges, fork tips, and sharp edges of kitchen utensils, pans, and other items that are cleaned. Detergent continuously flows through the devices of current art which is highly undesirable and wasteful. Consequently, detergent is not used efficiently and must be replaced frequently. This inefficiency becomes aggravated as the sponge wears and reduces in size due to cuts and abuse.

DISCLOSURE OF INVENTION

A general object of the invention is to provide an improved article washer that is both a washer and a scrubber, hereinafter referred to as a dish scrubber or scrubber, that is especially efficient in use and release of the detergent received in the hollow handle of the scrubber; and wherein one or two of small area apertures are provided in the scrubber handle adjacent its closed end for detergent release.

Another general object of the present invention is to provide a novel and improved dispensing container for liquids which has one or more open unobstructed passageways through a wall of the container, which may comprise a handle, and wherein the container and its passageways are dimensionally related such in designed size, shape, and location that the total forces of gravity, force due to hydrostatic pressure, force due to atmospheric pressure, forces of adhesion, forces of cohesion, surface tension phenomenon, and characteristics of the contained fluid operate to result in a net resultant force that will contain the fluid within the container when it is at rest, but release the fluid when additional force is applied to the contained fluid. Such additional force would be obtained simply by placing the container in motion. The reason flow does not take place when the device is at rest is due to the interacting relationship between container design, passageway dimensions and location, and the plurality of forces interacting within and without the device. It is possible to change or rearrange the design of the container, the dimensions and location of a passageway, and the interacting forces and still achieve the objective of having no flow when the device is at rest and positive flow when the device is put in motion. Thus, the interacting components are variables and several preferred embodiments of the invention are possible. Although this specification concentrates on the description of one preferred embodiment, it will be appreciated that the invention encompasses all possible embodiments.

Yet another object of the invention is to provide a dish scrubber that can have both a protective fibrous abrasive-cleaning surface provided thereon and also have a soft sponge surface exposed on the scrubber for more efficient cleaning action.

Yet another object of the invention is to provide a protective means in the dish scrubber to prevent the porous discharge sponge from normally contacting the discharge passageways in the detergent scrubber handle to prevent undesired and continual leaking or seepage of the detergent from the dish scrubber due to capillarity.

The foregoing and other objects and advantages of the invention will be more apparent as the specification proceeds.

Reference now is especially made to the accompanying drawings, wherein.

Figures 1, 2, 3, 4, 5:
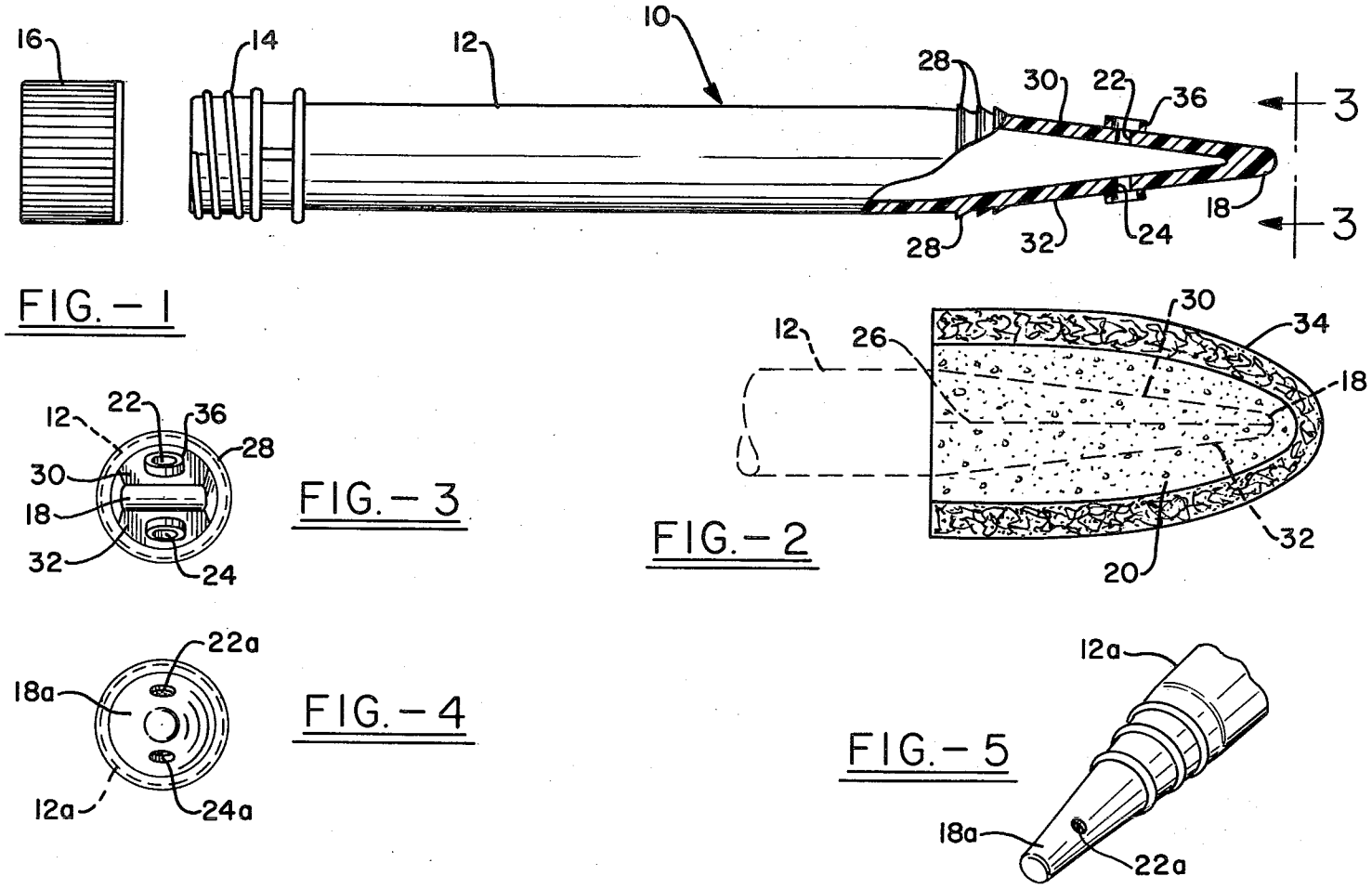
FIG. 1 is a side elevation of the container handle for the dish scrubber comprising one embodiment of the invention with a portion thereof being shown in the vertical section.
FIG. 2 is a fragmentary side elevation of the end of the dish scrubber of the invention with the foam end member positioned thereon.
FIG. 3 is an end elevation taken on line 3—3 of the tube of FIG. 1.
FIG. 4 is an end view, like FIG. 3 of the modified form of the tube of the invention.
FIG. 5 is a fragmentary perspective view of the container tube of FIG. 4.

When referring to corresponding articles shown in the drawings and referred to in the specification, corresponding numberals are used to facilitate comparison therebetween.

BEST MODE FOR CARRYING OUT THE INVENTION

The dispensing container may comprise an article or dish scrubber embodying the principles of the invention, and that includes a plastic handle having one closed end, one open end, and a removable closure for the open end; and the handle usually has a pair of horizontally aligned small apertures in its wall adjacent the closed end, a porous sponge body surrounding the closed end of the handle and extending up along the handle a short distance, and wherein the container and its passageways are dimensionally related such in designed size, shape, and location that the total forces of gravity, force due to hydrostatic pressure, force due to atmospheric pressure, forces of adhesion, forces of cohesion, surface tension phenomenon, and characteristics of the contained fluid operate to result in a net resultant force that will contain the fluid within the container when it is at rest, but release the fluid when additional force is applied to the contained fluid. Such additional force would be obtained simply by placing the container in motion. The porous sponge body may have an abrasion resistant fibrous top layer to prolong the operative life of the sponge body of the scrubber, and to add a scrubbing cleaning action to the device.

The disch scrubber of the invention is generally indicated as a whole by the numeral 10. The scrubber includes a support or hollow retainer handle 12 usually formed from a plastic material, such as polypropylene, and wherein this hollow handle 12 has a threaded open end 14 adapted to receive a closure 16 thereon. The handle 12 has one closed end 18 and a porous sponge body 20 and suitably engaged with and covers the closed end 18 and an area therearound of this handle 12. The dish scrubber is adapted to a design for receiving detergents therein and it is an important feature of the present invention that the handle 12 be provided with one or two horizontally aligned small area passageways or apertures 22, 24, as shown in FIG. 1, extending through the wall of the handle adjacent its closed end. These small apertures are designed to retain liquid detergent in the scrubber 10 unless it is placed in motion. The sponge body 20 may be adhesively secured to the hollow plactic handle.

Preferably the porous sponge body extending around the handle at its closed end is formed from conventional materials and it can be adhered to the container 12 in any conventional manner to be fixed in position to extend around the handle's periphery. For example, a suitable adhesive may secure the body 20 to the container handle 12. A longitudinally extending line 26 indicates where the opposed faces of a layer of the body of the sponge would normally be brought into abutting association to enclose the closed end of the container handle. Or the sponge could be molded or cast into a suitable shape as a unitary body, if desired. The engagement of the plastic handle 12, made from any conventional material, with the porous sponge body 20 may be facilitated by the provision of a plurality of retainer ribs 28 on the outer wall of the handle for engaging the inner surface of the sponge body 20.

In operation and use of the dish scrubber of the invention, it is important that the detergent not be wasted or be released extremely readily from the handle 12. Hence, usually small diameter apertures are formed in the sidewalls of the handle and, for example, a hole diameter of 3/64 inch has been used in the handle of the invention and where such aperture is located about $\frac{3}{4}$ inch from the closed tip 18 and the outer end thereof. These apertures 22 and 24 are shown in the present embodiment of the invention as being formed in horizontally aligned portions of a pair of flat surfaced side portions 30 and 32 provided on the handle 12 at its closed end and this construction plus the blunt end 18, that is closed, provides a dish scrubber that can be worked into more limited areas and corners for cleaning action.

Preservation of the sponge body 20 and obtaining a good service life therefrom, is facilitated by the provision of an abrasive fibrous layer 34 suitably bonded to the cellulose sponge body 20 on opposed surfaces thereof and extending around the blunt end 18 of the handle 12. Such layer 34 can be secured to the sponge body 20 by any known technology including forming the sponge when contacting the fibrous layer. Hence, the abrasive fiber layer 34 can be used for both scrubbing and washing action or, if desired, the soft sides of the porous sponge body 20 can be used for the cleaning action. This matted abrasive fibrous layer 34 can be made from any suitable material and nylon or polyester fibers have been used with good results. Glass, metal, mineral or other fibers may also be used in matted or woven forms. The fibers may be suitably adhered to each other and/or to the sponge body in any known manner, or an abrasive fiber sack may be secured around all or part of the sponge, as desired.

It has been determined in use that the surface tension of detergent within the area of apertures 22 or 24 is broken or destroyed when the sponge body 20 extends into contact with the liquid as contained in hollow handle 12. Thus, so as to prevent this physical contact with the sponge body 20 and the detergent liquid, the provision of a protective rim flange 36 around each of the apertures 22 and 24 has been made, and they form an important part of the invention. These rim flanges are usually spaced radially a short distance from the apertures 22 and 24 for example, rim flange I.D. $\frac{3}{8}$', and extend out from the adjacent wall surfaces 30 and 32 a distance sufficient to maintain the sponge 20 away from the open areas of apertures 22 and 24 when the scrubber is at rest, for example, a short distance, such as $\frac{1}{8}$ inch. This physical separation of the sponge body 20 from the adjacent flat surfaces 30 and 32 prevents unintentional breaking of the surface tension of the detergent and prevents undesired flow of the liquid from the container or handle 12. However, when the handle 12 is placed in motion at that time, sufficient forces are generated within the handle that the liquid detergent will flow out through the apertures 22 and 24 to saturate the sponge body 20 and work its way out to the surface for cleaning purposes. Wetting the sponge body with water prior to its use is desirable to dilute and facilitate flow of the detergent into and through the sponge body.

FIGS. 4 and 5 show a dispenser container or handle 12*a* that has a conical closed end 18*a*. A pair of small unobstructed passageways 22*a* are formed in this end 18*a*. Detergent will be retained in the handle 12*a*, unless it is placed in motion, in the manner as described hereinbefore. Axially spaced retainer ribs are formed on the handle 12*a*.

The dispensing container of the invention has unusual and unexpected properties, which are explained to the best of my knowledge and belief hereinafter. A plurality of different types of forces are being exerted on the detergent, or other liquid received within the dispensing container. Forces are urging the liquid to be flowing or dropping out through the discharge aperture or passageway provided and, likewise, there are a plurality of complex forces tending to exert external pressure on the container's contents to retain the detergent or the liquid in the container. The molecular forces being exerted on the contents of the container, the surface tension of the material in the container, the hydrostatic pressures set up on the contents of the container, the size of the discharge aperture and the container shape all are some of the many factors that act to create an overall net force exerted upon the container and its contents. My invention provides for nearly equalization of these forces under normal circumstances when the container is at rest, wherein the external forces are superior to the internal discharge forces and the liquid stays within the container whereas motion of the container will set up additional forces on the fluid to provide discharge thereof. Usually I prefer to have two small apertures or passageways in this container, as shown in the drawings. But, I do not wish to be limited as to use of more than one of such apertures, nor is the size of the individual apertures limited, except that one cannot use such a large aperture that the liquid would flow from the container at all times.

It is important that if more than one aperture or passageway is provided, these two or more apertures must comply with the principles of the invention as set forth hereinbefore, and be horizontally aligned or be in a plane perpendicular to the direction of gravity, or nearly thereso, in the normal use position of the dish scrubber. If the apertures are appreciably misaligned, continuous flow of liquid will take place through the aperture located nearest the center of gravity.

Units of the invention provide efficient, readily controlled liquid discharge action so that the objects of the invention are achieved.

While several complete embodiments of the invention have been disclosed herein, it will be appreciated that modification of these particular embodiments of the invention may be resorted to without departing from the scope of the invention.

What is claimed is:

1. A dish scrubber comprising:

a hollow handle having one closed end, one opened end, and closure for such opened end, said handle having a plurality of small area apertures in its wall adjacent said closed end;

said handle closed end portion being formed by a pair of opposed, tapered flat side portions defining a blunt point at such closed end;

a porous sponge body surrounding said closed end of said handle and extending up along said handle beyond said apertures some distance from said closed end; and an abrasive fibrous surface layer on said porous sponge body and extending over at least said pair of opposed tapered side portions of said handle closed end and said said sponge body to form a wear-resistant layer on the dish scrubber which is adapted to receive and retain a liquid detergent in said handle but to release a detergent through said apertures on motion of the scrubber, characterized in that said liquid is retained in said handle closed end portion and in said handle opened end portion, said plurality of apertures being formed in said flat side portions and are horizontally aligned perpendicular to the direction of gravity in the normal position of use of the dish scrubber, and a circular external raised flange is formed on said wall around said apertures but spaced in the plane of the wall from said apertures to prevent said sponge body from contacting said apertures.

2. A dish scrubber as in claim 1, where said sponge body is exposed on side areas thereof.

3. A dish scrubber as in claim 1, where a relatively thin surface layer is bonded to said sponge body.

4. A dish scrubber as in claim 1, where said surface layer comprises abrasive material.

* * * * *